United States Patent [19]

Satake

[11] Patent Number: 4,624,368

[45] Date of Patent: Nov. 25, 1986

[54] COLOR SORTING APPARATUS FOR GRANULAR OBJECTS

[75] Inventor: Toshihiko Satake, Higashihiroshima, Japan

[73] Assignee: Satake Engineering Co., Ltd., Tokyo, Japan

[21] Appl. No.: 583,212

[22] Filed: Feb. 24, 1984

[30] Foreign Application Priority Data

Mar. 26, 1983 [JP] Japan ..... 58-50773

[51] Int. Cl.[4] ..... B07C 5/342

[52] U.S. Cl. ..... 209/581; 209/587

[58] Field of Search ..... 209/580–582, 209/587, 546, 548, 549; 250/205, 226

[56] References Cited

U.S. PATENT DOCUMENTS

| | | | |
|---|---|---|---|
| 1,945,395 | 1/1934 | Cockrell | 209/587 |
| 3,360,650 | 12/1967 | Lawrence | 250/205 X |
| 3,639,768 | 2/1972 | Mancini | 250/205 |
| 4,097,732 | 6/1978 | Krause et al. | 250/205 |
| 4,105,123 | 8/1978 | Irving et al. | 209/580 X |
| 4,252,240 | 2/1981 | Satake | 209/580 |
| 4,371,081 | 2/1983 | Satake | 209/580 |
| 4,454,029 | 6/1984 | Codding | 209/581 |

FOREIGN PATENT DOCUMENTS

| | | | |
|---|---|---|---|
| 2091416 | 7/1982 | United Kingdom | 209/576 |

*Primary Examiner*—Robert B. Reeves
*Assistant Examiner*—Edward M. Wacyra
*Attorney, Agent, or Firm*—Wegner & Bretschneider

[57] ABSTRACT

The invention relates to a color sorting apparatus for granular objects in which detecting members (11, 11') for detecting acceptable objects and unacceptable objects respectively include light emitting members (9, 9; 9', 9') to send light to a sorting path (A), background light members (10; 10') to provide a reference amount of light, and light receiving members (8; 8') for receiving light coming from the objects in the sorting path and from the background light members; a valve actuating member (40) is responsive to the light receiving members for producing an ejection signal for unacceptable objects; ejection members (12, 13) are responsive to the valve actuating members for ejecting unacceptable objects; and adjusting members (19, 19) are responsive to the light receiving members for automatically adjusting the amount of light emitted from the background light members. The background light members (10, 10') include light sources (31, 31') which are adjusted by the adjusting members (19, 19) such that there is substantially no difference between the amount of light received by the light receiving members in the case where no objects exist in the sorting path and the amount of light in the case where acceptable objects exist therein even where the color tone of the acceptable objects is varied while in operation.

4 Claims, 6 Drawing Figures

COLOR SORTING APPARATUS FOR GRANULAR OBJECTS

BACKGROUND OF THE INVENTION

The present invention relates to a colour sorting apparatus for granular objects, and more particularly, to a colour sorting apparatus in which the background brightness is automatically controlled to be at an appropriate level while in operation.

A conventional colour sorting apparatus, with which acceptable and unacceptable granular objects or grains are sorted by their colour, has a disadvantage in that it is necessary to interrupt the sorting operation to adjust the background brightness to an appropriate level every time the tone of colour of the acceptable objects changes, and therefore, it takes time for the adjusting operation particularly in a colour sorting apparatus having a plurality of sorting units arranged in a horizontal row, thereby seriously deteriorating the sorting efficiency.

One object of the present invention is therefore to eliminate the disadvantage of the conventional colour sorting apparatus for granular objects.

Another object of the present invention is to provide a colour sorting apparatus for granular objects in which the background brightness is automatically adjusted according to the changes of the tone of colour of the acceptable objects while in operation.

Still another object of the present invention is to provide a colour sorting apparatus for granular objects in which the difference in the amount of light received by a light receiving element in the case where acceptable objects exist in a sorting path in a sorting chamber and in the case where no object exists in the sorting path is automatically controlled to be substantially zero while in operation, so as to make it possible to perform the sorting operation with high efficiency, thereby attaining high volume production of finely selected granular objects.

Still another object of the present invention is to provide a colour sorting apparatus having a plurality of sorting units arranged in a horizontal row in which the automatic adjustment of the background brightness can be successively performed over a plurality of colour sorting units.

SUMMARY OF THE INVENTION

To attain the above-mentioned objects, according to the present invention, there is provided a colour sorting apparatus for granular objects comprising: means for bringing objects to a sorting path; means disposed on an extended line of the sorting path for collecting acceptable objects; means disposed adjacent to the collecting means for discharging unacceptable objects out of the apparatus; means disposed at opposite sides along the sorting path for detecting acceptable objects and unacceptable objects, the detecting means respectively including light emitting means to send light to the sorting path, background light means to provide a reference amount of light, and light receiving means for receiving light coming from the objects in the sorting path and from the background light means; a valve actuating means responsive to the light receiving means for producing an ejection signal when any unacceptable objects are present in the sorting path; means responsive to the valve actuating means for ejecting unacceptable objects to the discharging means; and adjusting means responsive to the light receiving means for automatically adjusting the amount of light emitted from the background light means; the background light means including light sources being adjusted by the adjusting means such that there is substantially no difference between the amount of light received by the light receiving means in the case where no objects exist in the sorting path and the amount of light received by the same in the case where acceptable objects exist even where the colour tone of the acceptable objects is varied while in operation.

BRIEF DESCRIPTION OF THE DRAWINGS

These and other objects, features and advantages of the present invention will be more fully understood by reference to the following detailed description when considered in connection with the accompanying drawings; in which.

DESCRIPTION OF THE PREFERRED EMBODIMENTS

Figure 1:
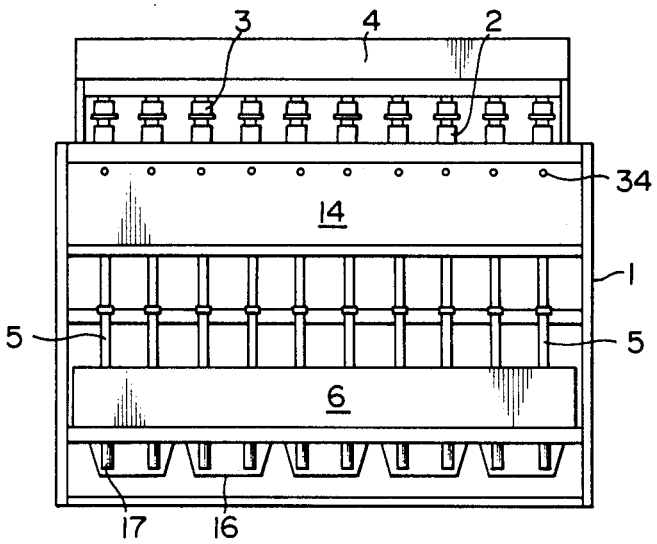
FIG. 1 is a front view of an embodiment of the colour sorting apparatus for grain according to the present invention.

Referring first to FIGS. 1 to 4, a preferred embodiment of the present invention will be described hereunder. The example of the colour sorting apparatus herein described is one used for sorting, for example, rice grains. In this embodiment, a colour sorting apparatus is provided with a machine frame 1 and a plurality of colour sorting units are attached on the machine frame 1. Each of the colour sorting units is constituted by a vibratory grain feeding device 3 provided with a vibratory device 2 and mounted on the machine frame 1, a slope path such as a chute 5 provided under the grain feeding device 3 such that the chute 5 communicates at its lower end portion with a chamber frame 7 of the photoelectric sorting chamber 6, a grain collecting tube 17 provided directly under the chute 5 at the lower portion of the photoelectric sorting chamber 6 for collecting selected acceptable grain, and a hopper 4 provided above the grain feeding device 3 for supplying grain to the grain feeding device 3. Each of the colour sorting units includes a switch 34 for electrically turning on/off the unit.

In the thus arranged colour sorting unit, the grain falling down from the hopper 4 into the vibratory grain-feeding device 3 due to the vibrations generated by the vibratory device 2 slips down along the chute 5 and falls down along a falling locus A (in FIG. 3) in the photoelectric sorting chamber 6. The falling locus A constitutes a grain sorting path.

In the photoelectric sorting chamber 6, a pair of photoelectric detection devices 11, 11' are provided at opposite sides along the falling locus A along which the grain falls down from the lower end of the chute 5. The pair of photoelectric detection devices 11, 11' have the same construction with each other. That is, the photoelectric detection device 11 is constituted by a light receiving element 8, two light sources 9, 9 and a background light device 10. The light receiving element 8 in the photoelectric detection device 11 receives only the light emitted from the background light device 10' provided in the other photoelectric detection device 11' when there is no grain in the grain sorting path A. On the other hand, when grain exists in the grain sorting path A, the light receiving element 8 receives the light which comes from the two light sources 9, 9 in the photoelectric detection device 11 and is reflected by the grain existing in the grain sorting path A, and it also receives the light which is emitted from the two light sources 9', 9' in the other photoelectric detection device 11' and is transmitted through the grain existing in the grain sorting path A as well as that part of the light which comes from the background light device 10' without being blocked by the grain in the grain sorting path A. The photoelectric detection device 11' functions in the same manner as the above photoelectric detection device 11. The light receiving elements 8, 8' included in the respective photoelectric detection devices 11, 11' produce respective electric signals corresponding to the amount of the received light. In the photoelectric detection devices 11, 11', the background light devices 10, 10' respectively include light sources 31, 31' which can be automatically adjusted such that the difference between the amount of light received by the light receiving element 8, 8' in the case where no grain exists in the sorting path A and the amount of light received by the same elements 8, 8' in the case where normal or acceptable grain exists in the above-mentioned sorting path A is kept to be substantially zero, even if the tone of colour of acceptable grain to be selected changes while in operation. This is achieved by respective background brightness adjusting circuits 19, 19 which will be described later. Thus, the light receiving elements 8, 8' always receive light of a substantially constant amount independent of the quantity of normal or acceptable grain existing in the grain sorting path A, so long as normal or acceptable grain exists in the grain sorting path A or even if no grain exists in the same. However, if foreign particles such as different colour grain, that is, any particles having a reflection factor different from that of the normal or acceptable grain pass the sorting path A, the amount of the light received by the light receiving element 8 and/or 8' varies temporarily. This temporary variation is detected to determine that foreign particles are mixed in the normal or acceptable grain.

Figure 2:
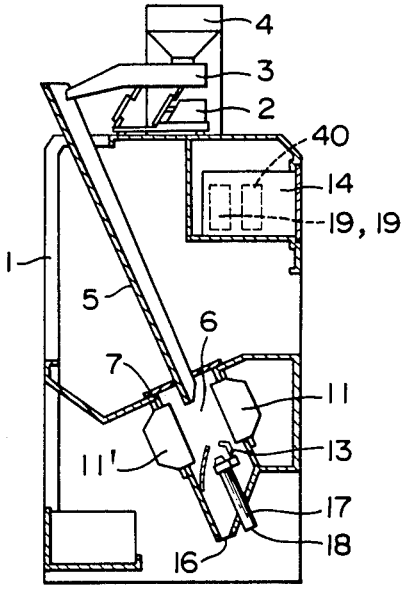
FIG. 2 is a side view, partly in section, of the apparatus of FIG. 1.

Each of the colour sorting units is provided with a control circuit 14 as shown in FIG. 2 and this control circuit 14 includes a valve actuating circuit 40 as well as the above-mentioned background brightness adjusting circuits 19, 19. The valve actuating circuit 40 is not described in detail here since various arrangements well known in the art can be used. The valve actuating circuit 40 is, for example, constituted by a series circuitry of an amplifier, a comparator, a delay circuit and a driver circuit.

Figure 3:
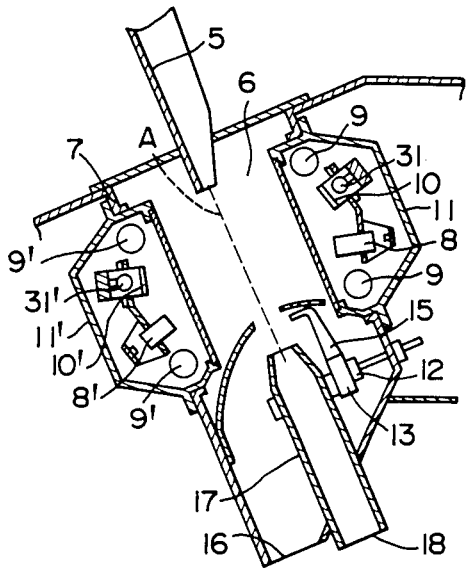
FIG. 3 is a cross-section of the photoelectric sorting chamber in the apparatus of FIG. 2.

Each of the colour sorting units is further provided with an air ejection device 13 having the electromagnetic valve 12 and an air ejection nozzle 15 and attached on the side of the grain collecting tube 17 at its upper portion as shown in FIG. 3. The electromagnetic valve 12 is responsive to the output signal, that is, the ejection signal from the valve actuating circuit 40. That is, when foreign particles or different colour grains have passed along the grain sorting path or falling locus A, the valve 12 is to be opened to eject air through the air ejection nozzle 15 in time to blow aside the foreign particles or different colour grains to prevent them from entering the grain collecting tube 17. When the grains are judged to be normal or acceptable, that is, when there are no foreign particles or different colour grains in the sorting path A, the valve 12 is not to be opened, thereby allowing the normal or acceptable grains to enter the grain collecting tube 17. The normal or acceptable grains allowed to enter the grain collecting tube 17 are discharged through a normal grain outlet 18 formed at the lower end of the grain collecting tube 17, while the foreign particles or different colour grains blown aside by the air ejection nozzle 15 and prevented from entering the grain collecting tube 17 are discharged through a foreign particle outlet 16 provided at the bottom portion of the chamber frame 7.

Figure 4:
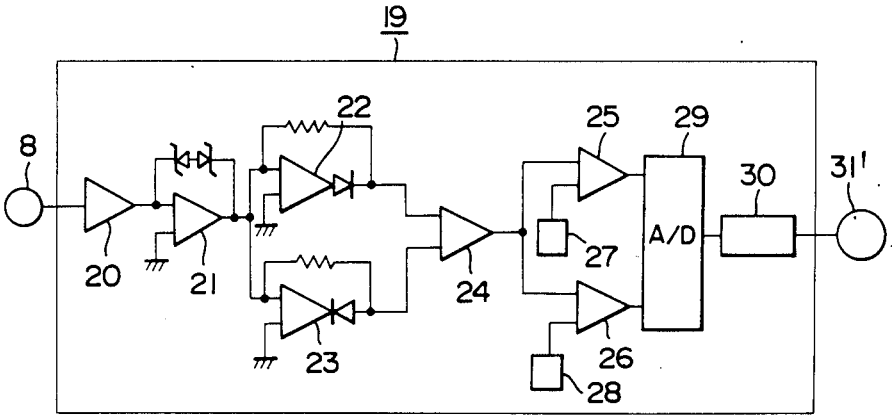
FIG. 4 is a schematic circuit diagram of an embodiment of the background brightness adjusting circuit included in the control circuit of FIG. 2.

FIG. 4 shows a schematic circuit diagram of one example of the background brightness adjusting circuit 19. The control circuit 14 includes a pair of the background brightness adjusting circuits 19, 19 for a pair of the photoelectric detection devices 11, 11', which are arranged in such a way that, when the colour tone of the acceptable grain changes, one circuit 19 provided for the light receiving element 8 automatically adjusts the amount of light emitted from one background light device 10' in one detection device 11' and the other circuit 19 provided for the light receiving element 8' automatically adjusts the amount of light emitted from the other background light device 10 in the other detection device 11. The background brightness adjusting circuit 19 is constituted by an amplifier 20, a limiter 21, a first half-wave rectifier circuit 22, a second half-wave rectifier circuit 23, a differential amplifier 24, a first comparator 25, a second comparator 26, an A/D converter 29, and a driver circuit 30.

Explained herein is the actual operation of one background brightness adjusting circuit 19 which controls the amount of light emitted from the light source 31' based on the signal from the light receiving element 8. The limiter circuit 21 receives the output signal from the light receiving element 8 through the amplifier 20 and provides respective predetermined threshold values for the positive and negative amplitudes with respect to a predetermined level so as to produce a first output signal representing the positive amplitude restricted to be below the predetermined positive limit value and a second output signal representing the negative amplitude restricted to be over the predetermined negative limit value, depending on the amplitude of the output signal of the amplifier 20, that is, depending on the amplitude of the output of the light receiving element 8. The first and second output signals of the limiter 21 are received by the first and second half-wave rectifier circuits 22 and 23, respectively. The respective outputs of the first and second half-wave rectifier circuits 22 and 23 are applied to the respective inputs of the differential amplifier 24 which produces a positive output or a negative output depending on the values of the respective outputs of the first and second half-wave rectifier circuits 22 and 23, that is, depending on the amplitude of the output signal of the light receiving element 8. The output of the differential amplifier 24 is applied to one of the respective inputs of the first and second comparators 25 and 26. Reference values established by the respective reference value setters 27 and 28 are applied to the respective other inputs of the first and second comparators 25 and 26 which compare the output of the differential amplifier 24 with their own reference values to thereby produce output signals representing the direction and the amount of correction of the light amount of the light sources 31' in the background light devices 10'. That is, for example, the output signal of the first comparator 25 indicates that the amount of light is to be increased, while the output signal of the second comparator 26 indicates that the amount of light is to be decreased. Thus, neither one of the first and second comparators 25 and 26 produces its output signal at the same time. The output signal of either one of the comparators 25 and 26 is applied to the A/D converter 29 in which the output signal of the comparator 25 or 26 is converted into a digital signal indicating in a digital value the direction and the amount of light to be corrected for the light sources 31'. Thus, the amount of light emitted from the light sources 31' is corrected when the amount of light received by the light receiving element 8 becomes inappropriate according to the changes of the colour tone of the acceptable grain. That is, even in the case where the colour tone of the normal or acceptable grain changes, the amount of light emitted from the background light devices 10' is automatically controlled so as to maintain the above-mentioned condition, that is, the amount of light received by the light receiving element 8 is maintained constant so long as only the normal or acceptable grain, regardless of the quantity thereof, exists or no grain exists in the sorting path A. If the colour tone of normal or acceptable grain to be selected varies while in operation, the background brightness adjusting circuit 19 automatically changes the brightness of the background light device 10' by an appropriate amount. In the same manner as explained above, the other background brightness adjusting circuit 19 controls the amount of light emitted from the background light device 10 which is disposed opposite to the light receiving element 8'.

Figure 5:
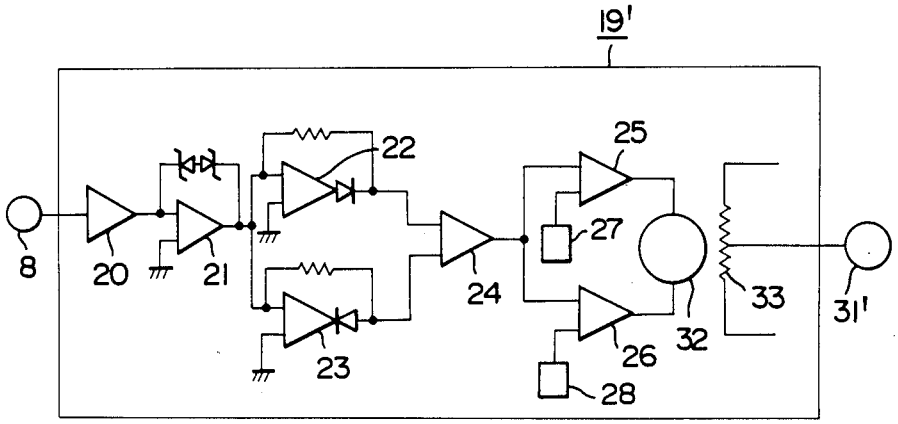
FIG. 5 is a schematic circuit diagram of another embodiment of the background brightness adjusting circuit.

FIG. 5 shows a schematic circuit diagram of another embodiment of the background brightness adjusting circuit 19' which is different from the circuit 19 as shown in FIG. 4 in that the A/D converter 29 and the driver circuit 30 in the latter are replaced by a servomechanism including a servo-motor 32 and a potentiometer 33. The servo-motor 32 is responsive to the output signal from either one of the comparators 25 and 26, similarly to the case of FIG. 4 embodiment, to rotate the potentiometer 33 in the direction and in the amount indicated by the output signal of the comparator 25 or 26 to adjust the amount of light emitted from the light sources 31'.

Although the description has been made above such that a pair of the background brightness adjusting circuits 19, 19 are provided for a pair of the photoelectric detection devices 11, 11' in one colour sorting unit, a single background brightness adjusting circuit 19 may be provided W commonly for the pair of photoelectric detection devices 11, 11'.

Figure 6:
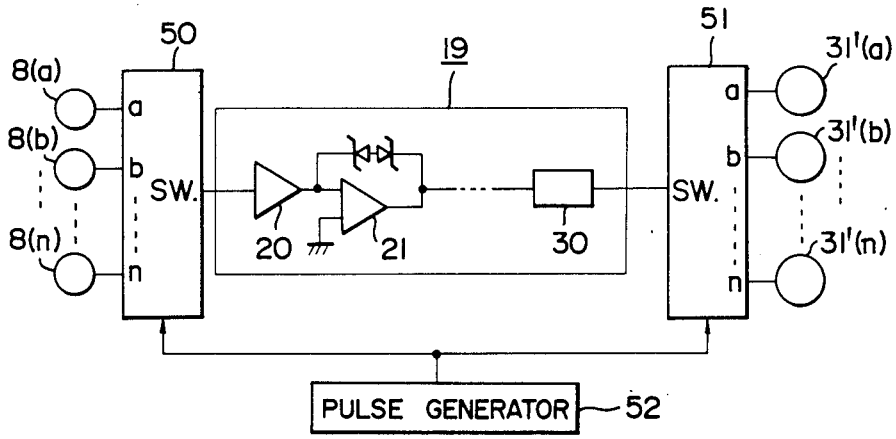
FIG. 6 is a block circuit diagram of another embodiment of the background brightness adjusting circuit.

Further, in practical use, a single pair of background brightness adjusting circuits can be used effectively for all or a plurality of the colour sorting units of the apparatus. The reason that a single pair of background brightness adjusting circuits is sufficient for a plurality of the colour sorting units in practical use is that after the background brightness in one colour sorting unit has been once adjusted, it would not be necessary to then frequently adjust the background brightness in that colour sorting unit because normally the colour tone of the normal or acceptable grain to be sorted does not change so frequently. FIG. 6 shows an embodiment in which only one pair of the background brightness adjusting circuits 19, 19 is used and the adjustment of the background brightness is automatically and successively performed for all the colour sorting units (a–n) by using, for example, a scanner circuit. In FIG. 6, the respective outputs of all the light receiving elements 8(*a*), 8(*b*) . . . 8(*n*) are connected to the input terminals a, b . . . n of a first stepping switch means 50 so that the outputs of all the light receiving elements 8(*a*), 8(*b*) . . . 8(*n*) are successively input to the amplifier 20 of the background brightness adjusting circuit 19 of FIG. 4 and the output of the driver circuit 30 of the same circuit 19 is input to a second stepping switch means 51 similar to the switching means 50. The output of the driver circuit 30 is applied to the background light sources 31'(*a*), 31'(*b*) . . . 31'(*n*) successively through the output terminals a, b . . . n of the second switching means 51. The switching operation of the first and second switching means 50 and 51 is performed in a synchronous manner by a pulse signal produced by a pulse generating circuit 52. That is, the pulse generating circuit 52 produces a pulse signal successively at a predetermined period of time, which is sufficient for each colour sorting unit to adjust the background brightness. Thus, the first and second switch means 50 and 51 and the pulse generating circuit 52 constitute an automatic scanner circuit. In this manner, in response to the output of one light receiving element 8(*b*) in the colour sorting unit (b), the background brightness adjusting circuit 19 adjusts the amount of light of corresponding background light source 31'(*b*) in the same unit (b).

It is, of course, understood that the background brightness adjusting circuit 19' of FIG. 5 can be employed in the embodiment of FIG. 6 in place of the background brightness adjusting circuit 19 of FIG. 4.

Although the description has been made as to a colour sorting apparatus having a plurality of sorting units, the invention can be of course applied to a single type colour sorting apparatus. In this case, of course, only one pair of the background brightness adjusting circuit as shown in FIG. 4 or FIG. 5 can be used for automatically adjusting the amount of light emitted from the background light sources.

Further, the reason that a pair of photoelectric detection devices are used in each of colour sorting units is to enhance the ability of the apparatus to detect existence of unacceptable objects and, therefore, it is of course understood that the use of a single detection device with the component elements thereof being appropriately rearranged may be possible in the case where such a severe accuracy is not required.

While the invention has been described in its preferred embodiments, it is to be distinctly understood that the invention is not limited thereto but may be otherwise variously embodied within the scope of the following claims.

What is claimed is:

1. A colour sorting apparatus for granular objects comprising a plurality of colour sorting units, each unit having:

means for feeding the granular objects to a sorting path;

collecting means for collecting acceptable objects;

discharging means for discharging unacceptable objects;

ejecting means for blowing aside the unacceptable objects to said discharging means;

detecting means disposed at opposite sides along said sorting path each including light emitting means to send light to said sorting path, background light means to provide a reference amount of light, and light receiving means for receiving light coming from the objects in said sorting path and from said background light means; and valve actuating means connected to said ejecting means and responsive to said light receiving means for producing an ejection signal when there comes any unacceptable object in said sorting path, said colour sorting apparatus further comprising:

a continuous adjusting means connected between said light receiving means and said background light means for producing a correction signal which indicates the necessary amount and direction of correction to be effected as to the amount of light emitted from said background light means based on the amplitude and the polarity of the output of said light receiving means with respect to a predetermined level, and for automatically adjusting the amount of light emitted from said background light means in accordance with said correction signal, so that there is substantially no difference between the amount of light received by said light receiving means in the case where no objects exist in said sorting path and the amount of light received by said light receiving means in the case where only acceptable objects exist even when the colour tone of the acceptable objects is varied during sorting operation; and a scanner circuit means connected to said adjusting means for effecting sidewise switching-over operation among said plurality of colour sorting units in such a manner that said adjusting means is commonly provided for all of said colour sorting units and is connected successively to each of said light receiving means and said background light means of the corresponding colour sorting unit for a predetermined period of time which is sufficient to fully correct the amount of light emitted from each of said background light means.

2. A colour sorting apparatus for granular objects according to claim 1, wherein said adjusting means comprises two parallely connected comparators which are connected through an amplifier and first and second half-wave rectifier circuits to a corresponding light receiving means and each of which is provided with a corresponding reference value setter, and the outputs of said comparators are connected with control means in order to effect said automatic adjustment of the emitted amount of light of said background light means.

3. A colour sorting apparatus for granular objects according to claim 2, wherein said control means comprises an analog-digital converter with a following driver.

4. A colour sorting apparatus for granular objects according to claim 2, wherein said control means comprises a servo-motor connected to a potentiometer.

* * * * *